United States Patent [19]

Kinghorn, Sr. et al.

[11] 4,191,303

[45] Mar. 4, 1980

[54] LIQUID STORAGE TANK SEALING SYSTEM

[76] Inventors: Mark D. Kinghorn, Sr., P.O. Box 1333, Rte. 30, Schererville, Ind. 46375; Mark D. Kinghorn, Jr., 11903 W. 90th, St. John, Ind. 46373

[21] Appl. No.: 19,080

[22] Filed: Mar. 9, 1979

[51] Int. Cl.[2] ..... B65D 87/207; B65D 87/20

[52] U.S. Cl. ..... 220/222; 220/226

[58] Field of Search ..... 220/222, 224, 216, 218, 220/221, 226

[56] References Cited

U.S. PATENT DOCUMENTS

| | | | |
|---|---|---|---|
| 2,314,805 | 3/1943 | Wiggins | 220/222 |
| 2,997,200 | 8/1961 | Giannini et al. | 220/222 |
| 4,116,358 | 9/1978 | Kinghorn et al. | 220/222 |
| 4,130,217 | 12/1978 | Hills et al. | 220/226 |

*Primary Examiner*—Steven M. Pollard

*Attorney, Agent, or Firm*—August E. Roehrig, Jr.

[57] ABSTRACT

A sealing system for a liquid storage tank having a roof freely floating on the liquid contained within the storage tank wherein a plurality of shield sections are structurally interlocked to eliminate the need for a vapor-impermeable fabric annulus overlying the shield and interface between adjacent sections of the shield and effectively preventing vapor from escaping from the tank and contaminants from entering into the liquid. The structural interlocking of adjacent shield sections provides a uniform distribution of the forces and counter forces exerted between the floating roof and the inner wall of the tank shell due to wind loading.

20 Claims, 12 Drawing Figures

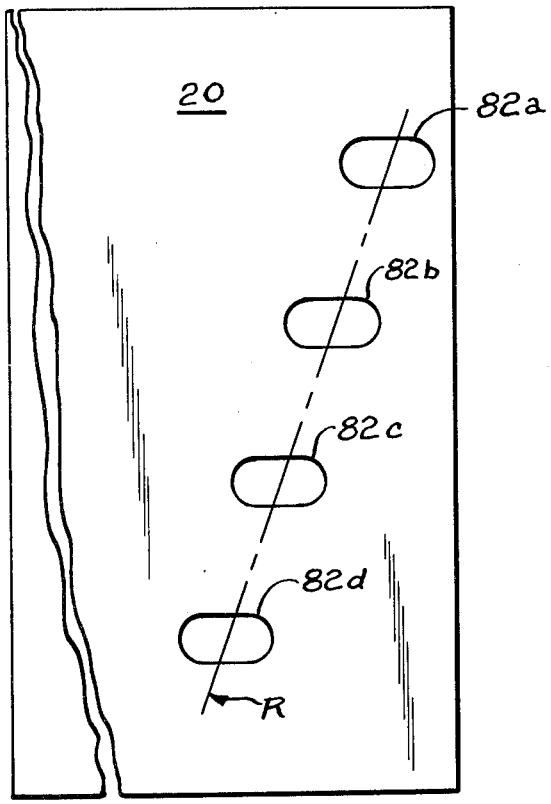
Fig. 8
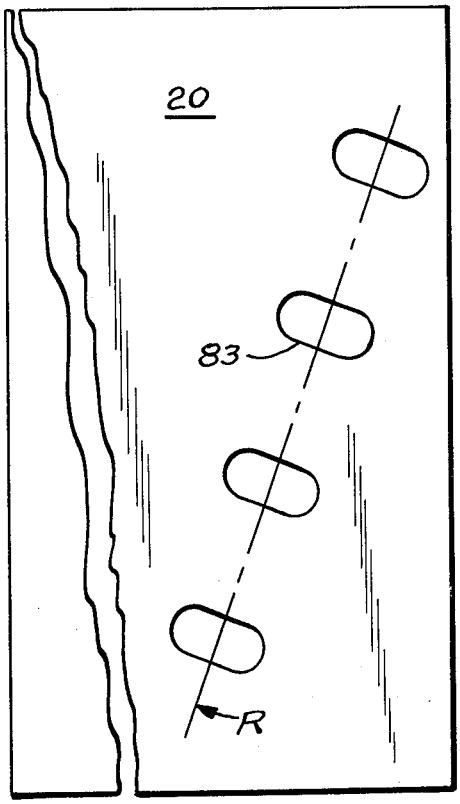
Fig. 9
Fig. 10
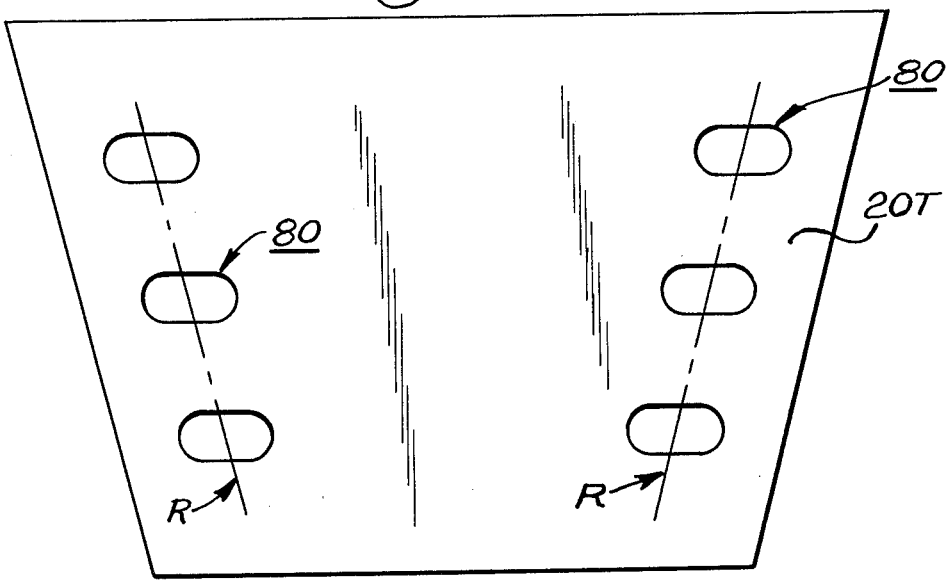

LIQUID STORAGE TANK SEALING SYSTEM

BACKGROUND OF THE INVENTION

This invention relates in general to sealing systems for liquid storage tanks and, in particular, to a sealing system for preserving the integrity of liquid contained in a liquid storage tank having a roof freely floating on the liquid contained within the storage tank.

More specifically, but without restriction to the particular use which is shown and described, this invention relates to a combined weather shield and vapor seal for sealing the opening or space between the floating roof and the inner wall of a storage tank.

When storing liquids in large containers, such as storage tanks of the type having a roof which floats on the liquid contained in the storage tank, it is necessary to prevent the liquid from becoming contaminated by rain, snow, ice, dust, dirt and the like, and to prevent loss of the liquid stored therein through evaporation or vaporization. Evaporation losses are not only costly due to the loss of the stored liquid, but may be dangerous or contaminate the environment. To this end vapor loss is closely controlled by government pollution control agency regulations which require the sealing system to meet specific emission control or vapor loss standards. The sealing system of the present invention has met the most stringent requirements for emission control and vapor loss standards, including Rule 463 of the California Air Resources Board.

Since the level of liquid contained within such storage tanks frequently changes, the roof is designed to rise and fall with the liquid contained in the storage tank. In order to allow the storage tank roof to freely rise and fall with the level of the liquid contained in the tank, the roof is designed with a diameter less than the inner diameter of the tank shell. Contaminants are prevented from entering the liquid by a weather shield which covers the rim space extending between the roof or pontoon and the inner wall of the tank or shell. A vapor barrier or seal is used to prevent evaporation of the liquid through this same rim space.

In order to meet these requirements, the storage tank sealing system must conform to any distortions or irregularities in the inner walls of the storage tank shell. In addition, since the tank roof or pontoon floats on the liquid contained within the storage tank, the roof will shift due to wind loading which destroys concentricity between the roof and tank shell. Therefore, it is known to those skilled in the art that the sealing system must allow for such movement between the roof and the inner wall of the shell in order to maintain an effective seal throughout the extremes of such wind loading induced movement as well as to compensate for distortion and irregularities in the tank shell.

Many and various approaches have been taken in an attempt to provide a satisfactory sealing system for storage tanks having a floating tank roof. For example, the sealing systems disclosed in U.S. Pat. No. 3,589,549 and U.S. Pat. No. 3,119,511 utilize separate structure to function as a primary or vapor seal, and a secondary or weather shield. With seals of this type the primary or vapor seal comprises an annular tubular casing, typically of self-supporting resilient material of a cellular structure, which is pressed into sealing engagement with the inner wall of the tank shell to form a vapor tight seal to prevent evaporation losses from the tank. A weather shield, which has a flexible or resilient bumper carried on the outermost edge of an annular array of individual plate-like hood segments, is secured to the upper portion of the floating roof and extends a length sufficient to maintain engagement with the inner wall of the tank shell to be effective throughout the conditions previously described. Other examples of the use of separate primary and secondary seals are disclosed in U.S. Pat. No. 1,992,221; U.S. Pat. No. 3,373,891; and U.S. Pat. No. 3,900,127. In each of these prior art systems the primary seal which forms a vapor barrier comprises a flexible, vapor-impermeable fabric extending between the floating roof and the inner wall of the cylindrical tank shell to prevent loss of the liquid by evaporation.

A further attempt to provide a successful sealing system is disclosed in U.S. Pat. No. 1,879,572 wherein a plurality of spaced adjacent spring steel sections are inclined outwardly from the upper portion of the floating roof a distance substantially further than the space between the roof and the tank wall. The adjacent sections are spaced laterally to provide for horizontal expansion and contraction of the tank and distortion of the sections. A flexible, pliable web, preferably of fabric, is secured to each of the laterally spaced sections.

With these prior art sealing systems, utilizing separate primary and secondary seals, in order to inspect the primary or vapor seal to insure that it is still effective and does not require repair, the secondary or weather shield seal must be moved to give access to the vapor seal. In such sealing systems it is necessary that the weather shield be readily positionable to allow inspection of the vapor seal without requiring extensive labor, or causing damage to the weather shield, when it is necessary to inspect or repair the vapor seal.

Another problem associated with many prior art sealing systems which utilize a separate primary and a separate secondary seal is that the secondary seal is sometimes attached to the primary seal. Such attachment does not allow for easy inspection. Furthermore, in the event the vapor seal becomes distorted or loses its sealing capabilities, the weather shield is not sufficient to provide a vapor barrier. Such systems frequently require that the seals be removed from the tank if the tank shell structure itself ever needs repair, because burning or welding on the tank structure will destroy the seals.

Certain attempts, such as disclosed in U.S. Pat. No. 3,373,831 and U.S. Pat. No. 4,116,358, have been made to utilize a single sealing structure as both a vapor barrier and a weather shield. In U.S. Pat. No. 3,372,831 a resilient material forms a wiper seal and is held in contact with the inner wall of the tank by an intermittently spaced series of separate arcuate strips which reinforce the wiper seal. While such a wiper seal (referred to in the art as a passive seal), may be somewhat effective, typically vapor pressure builds up under the seal until the vapor blows by the seal and escapes into the atmosphere. In addition, such a seal does not provide a sufficient centering force for resisting wind loading imposed on the tank roof.

The sealing system disclosed in U.S. Pat. No. 4,116,358 utilizes a single structure as both a weather shield and a vapor seal. A plurality of overlapping or abutting shield sections, preferably made of metal, are secured at one end to the upper portion of a floating roof and extend outwardly a length sufficient to form a sealing engagement with the inner wall of a tank in the manner disclosed in U.S. Pat. No. 1,879,572 and U.S.

Pat. No. 1,992,221. A flexible wiper blade, preferably of rubber, is secured to the free end of the shields, in a manner acknowledged in the patent to be known in the prior art, to engage the inner wall of the storage tank shell. An annulus of a gas-impermeable fabric covers the shield, about the perimeter of the roof, and overlies the shield sections to cover the interfaces between adjacent sections of the shield to prevent the loss of vapors from the interior of the tank to the atmosphere.

While such sealing systems have succeeded in overcoming certain problems encountered with separate primary and secondary sealing structures, the abutting or overlapping of shield sections requires an annulus of vapor-impermeable fabric to overlie the shield, extending between sealing engagement with the top of the floating roof and the flexible wiper which overlies the shield, in order to prevent vapor loss through the interface between adjacent shield sections. Since this vapor barrier forming fabric is carried on the outside of the shields, the vapor barrier deteriorates fairly quickly from such things as ozone, ultraviolet light, and atmospheric contaminants which are always present in the environment where such tanks are usually built. As a result, it has been found that when the fabric deteriorates the vapor which is intended to be trapped beneath the fabric permeates the fabric and is discharged into the atmosphere.

SUMMARY OF THE INVENTION

It is, therefore, an object of this invention to improve sealing systems for liquid storage tanks of the type wherein the tank roof is freely floating on the liquid contained therein.

Another object of this invention is to improve liquid storage tank sealing systems of the type utilizing a primary and secondary seal.

A further object of this invention is to eliminate the necessity for separate primary and secondary sealing elements.

Still another object of this invention is to maintain a predetermined contact between the sealing system and the inner walls of a liquid storage tank to prevent contaminants from entering therein and vapors from escaping therefrom.

Yet another object of this invention is to eliminate the necessity of a gas-impermeable fabric annulus extending about the perimeter of the storage tank in order to keep vapors from escaping therefrom.

A further object of this invention is to structurally interlock adjacent shield sections to evenly distribute the wind load and centering counter forces exerted between the roof and the tank shell.

These and other objects are attained in accordance with the present invention wherein there is provided a sealing system for a liquid storage tank having a roof freely floating on the liquid contained within the storage tank wherein a plurality of shield sections are structurally interlocked to eliminate the need for a vapor-impermeable fabric annulus overlying the shield and interface between adjacent sections of the shield and effectively preventing vapor from escaping from the tank and contaminants from entering into the liquid. The structural interlocking of adjacent shield sections provides a uniform distribution of the forces and counter forces exerted between the floating roof and the inner wall of the tank shell due to wind loading.

DESCRIPTION OF THE DRAWINGS

Further objects of the invention, together with additional features contributing thereto and advantages accruing therefrom, will be apparent from the following description of preferred embodiments of the invention which are shown in the accompanying drawings with like reference numerals indicating corresponding parts throughout wherein:

FIG. 8 is an alternative embodiment of a shield section as shown in FIG. 6 wherein slots formed therein are positioned to lie along a line extending substantially radially outward from the center of the storage tank roof;

FIG. 9 shows one end of another alternative embodiment of the shield section as shown in FIG. 6 wherein the slots utilized in effecting structural interlocking between adjacent shield sections extend along and normal to the radially extending line referred to with regard to FIG. 6;

FIG. 10 shows another alternative embodiment of the shield section in the manner described with reference to FIG. 6;

DESCRIPTION OF THE PREFERRED EMBODIMENTS OF THE INVENTION

Referring now to FIGS. 1–4, there is illustrated a portion of a liquid storage tank shell 10 having a floating roof 12, movable relative to the inner walls of the tank shell, closing the open end of the storage tank. The roof 12 is freely floating upon the liquid contained within the storage tank 10 in a manner known to those skilled in the art. In order to preserve the integrity of the liquid contained in the liquid storage tank 10, and to prevent vapors from escaping to the atmosphere, a suitable sealing system is utilized.

Figure 1:
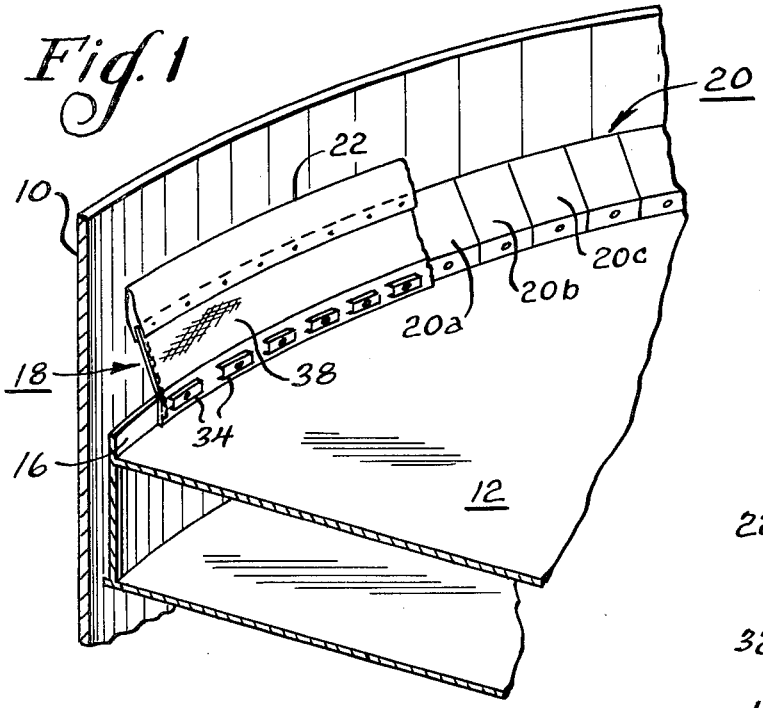
FIG. 1 is a frontal perspective view of a portion of a liquid storage tank utilizing a prior art sealing system which incorporates both a vapor seal and a weather shield into a single structure.
Figure 2:
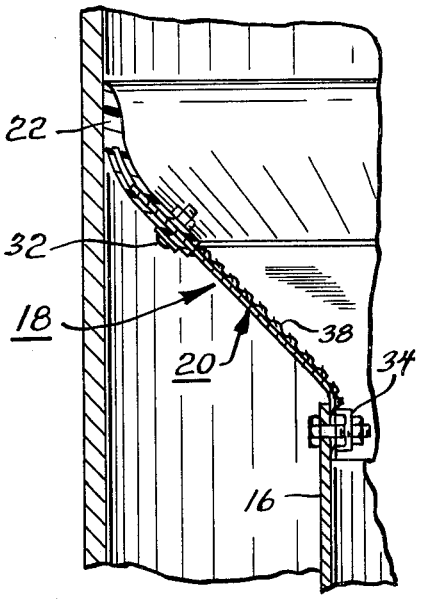
FIG. 2 is an enlarged cross sectional view of a portion of the sealing system shown in FIG. 1 to better illustrate how the present invention is different from the prior art.

A prior art sealing system, illustrated in FIGS. 1 and 2, comprises a seal 18 which extends completely around and entirely covers the annular rim space between the floating roof 12 and the side wall 10 of the tank or shell. The seal 18 is carried by a rim plate 16 which extends vertically upward from the roof 12 parallel to the side wall 10. The seal 18 includes a flexible shield 20, preferably of metal, and formed from a plurality of adjacent sections such as 20*a* and 20*b*. The adjacent sections may overlap or abut each other, but each of the adjacent contacting sections are shingled so as to be free to move relative to each other and are not structurally interlocked. A flexible wiper blade 22, preferably of rubber, is permanently coupled to the shield sections by means of conventional fasteners 32 which extend through the wiper blade 22 and the shield 20. The opposite end of the shingled shield sections 20, 20*b*, etc., is connected to an upper portion of the rim plate 16 by means of a channel bracket 34 which secures the shield sections firmly against the rim plate 16. A vapor seal of a flexible gas-impermeable fabric 38 covers the shield sections continuously around the perimeter of the roof, and covers the interfaces between adjacent shield sections to prevent loss of vapors from the interior of the tank to the atmosphere. The annulus formed by the fabric 38 is held in place between the wiper blade 22 and the shield 20 on one side while the inner circumferential edge is held between the channel bracket 34 and the shield 20.

With the fabric 38 thus secured, vapors within the rim space cannot escape to the atmosphere through the interfaces between adjacent shield sections or between the wiper blade 22 and the tank wall 10 as long as an effective seal is maintained between the tank wall 10 and the wiper blade 22. A suitable vapor barrier forming fabric 38 has a nylon fiber center sandwiched between layers of white chlorosulfonated polyethylene obtainable from Reeves Brothers, Vulcan Division, Buena Vista, Va., and sold under the trademark "HYPALAN". As previously discussed, while seals such as this are somewhat successful in eliminating certain of the problems associated with separate vapor seal and weather shield structures, these seals require an annulus of vapor-impermeable fabric which upon deterioration of the fabric 38 destroys the integrity of the vapor seal. In addition, since the adjacent shield sections are not structurally interconnected, but shingled, the forces and counter forces resulting from wind loading on the tank roof are not evenly distributed, but allow one end of each shield section to be readily fanned.

Figure 3:
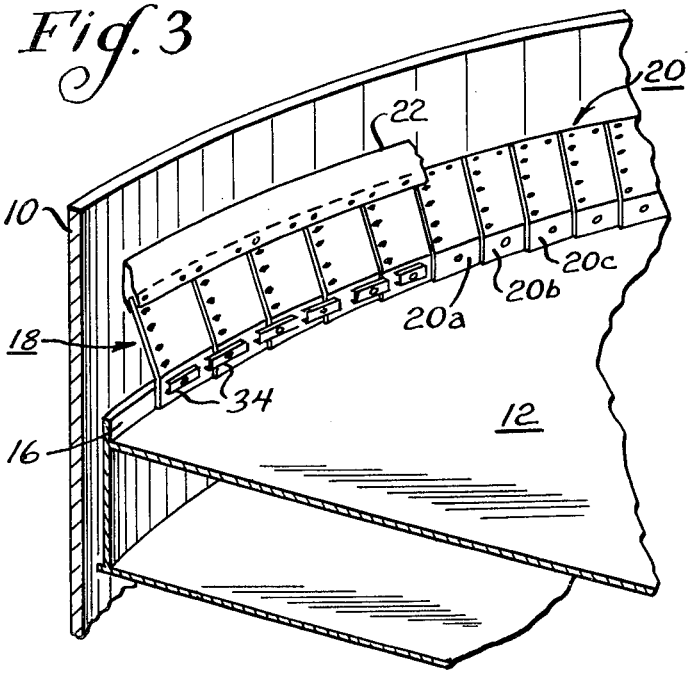
FIG. 3 is a frontal perspective view of a liquid storage tank utilizing the present invention.
Figure 4:
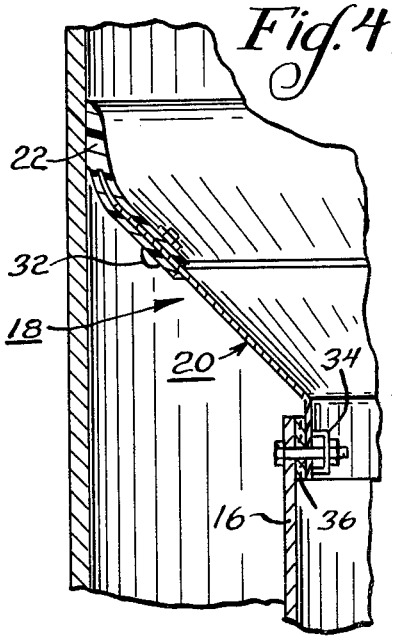
FIG. 4 is an enlarged cross sectional view of a portion of the sealing system shown in FIG. 3 to better illustrate one embodiment of the invention.

Referring now to FIGS. 3 and 4, there is illustrated one embodiment of the sealing system of the present invention which eliminates the problems associated with separate vapor sealing and weather shield structures, as well as the problems associated with the prior art seals discussed with reference to FIGS. 1 and 2. A plurality of shield sections 20*a*, 20*b*, etc., are positioned to overlap a portion of each other and are joined at their circumferential edge to the rim plate 16 of the floating roof 12. The inner circumferential edge of the shield sections 20 may be joined to the upper edge of the roof 12, such as by means of the channel brackets 34 previously described, as long as a strip of suitable gasket material is placed between adjacent contacting metal surfaces to prevent vapors from leaking therebetween. For additional arrangements that may be used for connecting the inner circumferential edge of the shield 20 to a floating roof, reference is made to the inventors' co-pending application Ser. No. 873,218, filed on Jan. 30, 1978 which illustrates various configurations of attachments. However, strips of suitable gasket material must be placed between adjacent contacting metal attachment parts to prevent vapor from passing therebetween.

The outer end of the shield 20, which is positioned adjacent to the inner wall of the tank 10, has supported thereon a flexible wiper blade 22 which extends in sealing engagement about the inner periphery of the tank shell. The flexible wiper blade 22 is secured to the sections which form the shield 20 by conventional means such as bolts and washers with the material of the flexible shield 22, upon compression, forming a self-sealing gasket to prevent vapor from passing through the points of connection.

Figure 5:
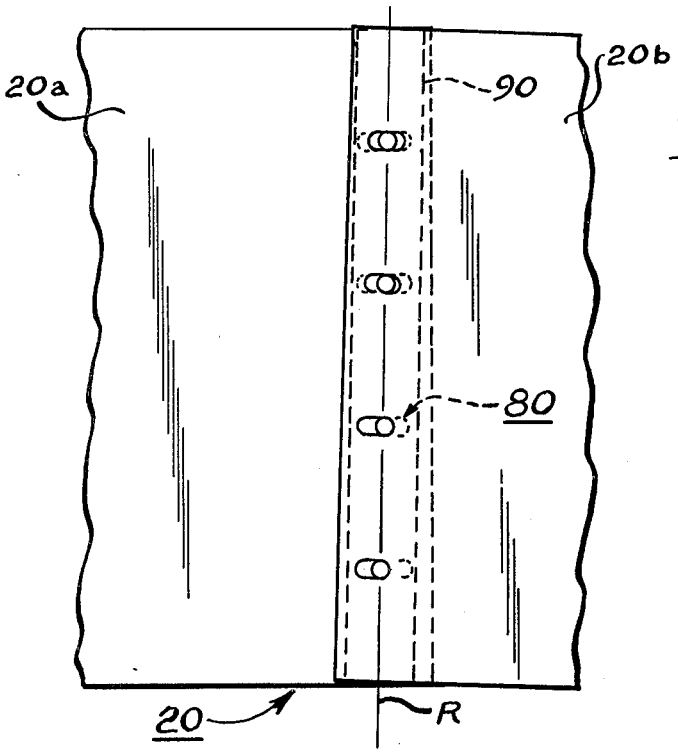
FIG. 5 is an enlarged horizontal planar view of a shield section with the flexible wiper blade removed and detached from the tank roof to better illustrate the manner in which adjacent shield sections are structurally interconnected.

In order to eliminate the necessity for an annulus of gaspermeable fabric extending continuously over the shield 20 and the interface between adjacent shield sections, the adjacent shield sections 20*a*, 20*b* and 20*c* are overlapped, preferably a distance of approximately 2 inches, with a strip of gasket material 90 positioned therebetween and then structurally interconnected as best shown in FIG. 5. As illustrated in FIG. 5 and the various embodiments such as disclosed in FIGS. 6 through 10, the shield sections are formed with a series of slots 80 along their adjacent sides. While four slots on each side of the shield section are illustrated, it is to be understood that the number of slots formed on each side of a shield section is determined by the length of the shield section (e.g. 20*a*) which in turn is determined by the distance between the tank shell 10 and the pontoon rim 16 to which the shield section is attached. The actual number of slots is dependent upon the compressibility of the gasket material which must be compressed sufficiently to form a liquid and vapor tight seal.

Figure 6:
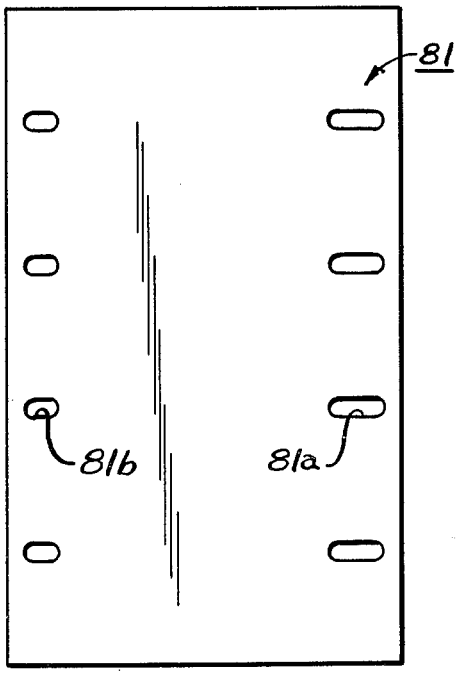
FIG. 6 is a horizontal planar view of one embodiment of the shield sections detached from the tank roof and having the wiper blade removed.
Figure 7:
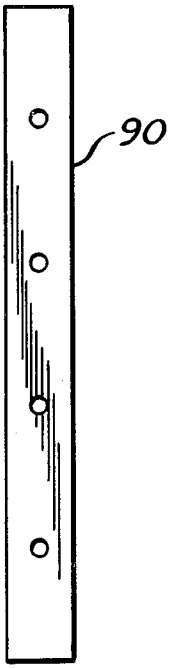
FIG. 7 is a horizontal planar view of a flat strip of gasket material which is utilized between adjacent shield sections to maintain the vapor seal integrity.

Initial experiments with interconnecting the shield sections 20*a*, 20*b*, etc., utilized sheet metal screws or punched circular holes through which bolts were passed to interlock adjacent shield sections. However, it was found that such interconnection of the shield sections would not function properly and rendered the sealing system inoperative. Thereafter, as shown in FIG. 6, a series of elongated slots 81 were utilized with the slots 81 extending parallel to the upper and lower edges of the shield sections. The slots 81*a* of the underlying edge of the shield section 20*a* were larger than the slots 81*b* of the overlying shield section 20*b*. These slots 81*a*, for example, on the underlying portion of shield section 20*a*, were approximately one inch in length and 5/16 inch wide, while the slots 81*b* on the overlying portion of the shield section 20*b* were one-half inch wide by 5/16 inch in width. The slots were formed in the shield sections to allow an approximately two inch overlap. The strip of gasket material, shown in FIG. 7 and approximately two inches wide, was prepunched with circular holes and positioned between the overlapping edges. A series of bolts, having suitable washers were passed therethrough, such that upon tightening of the bolts and washers the gasket material was compressed between the interlocked adjacent shield sections forming a vapor proof seal.

A further improved embodiment was effected wherein the slot lengths were standardized to one-half inch and 5/16's in width. The center of the slots was spaced progressively inwardly from the uppermost edge of the shield section along a line running substantially to the center of the floating roof and best illustrated in FIG. 8 and shown interconnected in FIG. 5. The slot pattern was such that the uppermost slot 82*a* formed in the shield 20*a*, and positioned in use adjacent to the flexible wiper 22, was nearest to the edge of the shield section. The lower slots (82*b*, 82*c* and 82*d*) progressed inwardly, respectively, along a radial line R extending substantially through the center of the tank. In this manner the adjacent interlocked shield sections could more easily move transversely, relatively to one another, and still maintain an effective seal by the gasket material compressed therebetween.

While it would be best, geometrically, to orient the slots perpendicular to a radial line R extending through the center of the tank and in the manner illustrated by the slots 83 in FIG. 9, it has been found that due to manufacturing tolerances, and the great distance of the radius of curvature relative to the slot size, the slots may be punched parallel to the upper and lower edges of the shield sections as shown in FIGS. 5, 6, 8 and 10, and do not require orientation perpendicular to the radial line in the manner disclosed in FIG. 9.

A further alternative embodiment is disclosed with reference to FIG. 10 wherein the shield sections are formed in a trapezoidal shape 20*t*. Such trapezoidal shape results in material savings and insures that the shield sections cannot be installed improperly.

Figure 11:
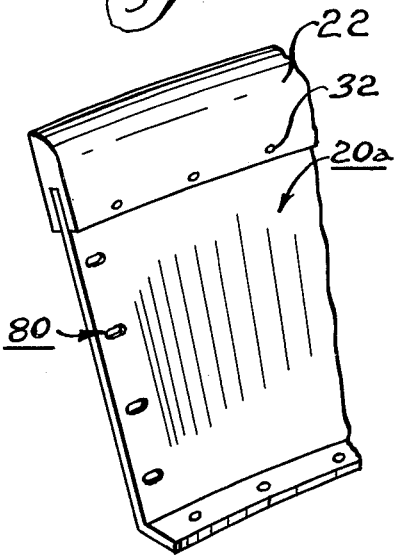
FIG. 11 is a frontal perspective view of a portion of a shield section with a flexible wiper secured at the free end and with the opposite end connecting to a portion of the floating roof.
Figure 12:
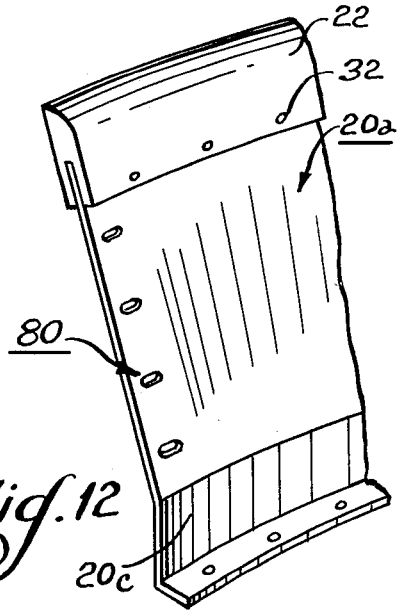
FIG. 12 is a frontal perspective view of another embodiment of the shield as described with reference to FIG. 11.

Referring to FIG. 11 the shield section 20*a* is shown formed with a mounting flange for joining to the rim plate 16. However, a further alternative embodiment of the shield section 20*a* is shown in FIG. 12 which is utilized for applications wherein it is desired or necessary to raise the shield section 20*a* to a greater height. In certain applications the increase in height of the shield section relative to the mounting flange is necessary and, accordingly, the shield section 20*a* is formed with a vertically extending panel portion 20*v* as illustrated.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A sealing system for sealing the space between a liquid storage tank shell and the tank roof freely floating on the liquid stored within the tank shell, the sealing system comprising a plurality of overlapped vapor-impermeable shield sections extending radially outwardly from the perimeter of a floating roof of a liquid storage tank for engaging a radially inwardly directed inner wall of the liquid storage tank to form a substantially liquid and vapor tight seal therewith, said plurality of overlapped vapor-impermeable shield sections having an inner end carried by the roof of the liquid storage tank and forming a substantially liquid and vapor tight seal therewith, a flexible sealing member carried on an outer end of said plurality of overlapped vapor-impermeable shield sections for engaging the radially inwardly directed inner wall of the liquid storage tank and forming a substantially liquid and vapor tight seal therewith, each of said plurality of overlapped vapor-impermeable shield sections being formed with a plurality of slots adjacent to each of the overlapping edges, gasket means carried between the overlapping portions of said plurality of overlapped vapor-impermeable shield sections, and fastener means passing through said plurality of slots formed in each of said plurality of overlapped vapor-impermeable shield sections, and said gasket means carried therebetween, for structurally interlocking said plurality of overlapped vapor-impermeable shield sections while allowing transverse movement therebetween in response to variation in the rim space during relative movement between the floating roof and the inner wall of the liquid storage tank and forming a substantially liquid and vapor tight seal between said overlapping edges.

2. The sealing system of claim 1 wherein said plurality of overlapped vapor-impermeable shield sections are formed with said plurality of slots which are adjacent to the underlapped edge extending a greater length than the plurality of slots adjacent to the overlapped edge.

3. The sealing system of claim 2 wherein said vapor-impermeable shield sections are trapezoidal shaped.

4. The sealing system of claim 1 wherein said plurality of vapor-impermeable shield sections are formed with said plurality of slots transversing a radial line passing substantially through the center of said roof.

5. The sealing system of claim 4 wherein said vapor-impermeable shield sections are trapezoidal shaped.

6. The sealing system of claim 4 wherein said plurality of slots are positioned perpendicular to said radially extending center line.

7. The sealing system of claim 6 wherein said vapor-impermeable shield sections are trapezoidal shaped.

8. The sealing system of claim 1 wherein said vapor-impermeable shield sections are trapezoidal shaped.

9. The sealing system of claim 1 wherein said vapor-impermeable shield means is formed with a vertically upwardly extending portion for further elevating said shield sections above said floating roof.

10. The sealing system of claim 1 wherein said flexible sealing member comprises a wiper blade seal.

11. A sealing system for sealing the space between a liquid storage tank shell and the tank roof freely floating on the liquid stored within the tank shell, the sealing system comprising a plurality of overlapped vapor-impermeable shield sections for engaging a radially inwardly directed inner wall of a liquid storage tank to form a substantially liquid tight seal therewith, said plurality of overlapped vapor-impermeable shield sections having an inner end adapted to be carried by a floating roof of the liquid storage tank and to form a substantially liquid and vapor tight seal therewith, said plurality of overlapped vapor-impermeable shield sections being positionable to extend radially outwardly from the perimeter of the roof of the liquid storage tank toward the radially inwardly directed inner wall thereof, a flexible sealing member carried on an outer end of said plurality of overlapped vapor-impermeable shield sections for engaging the radially inwardly directed inner wall of the liquid storage tank to form a substantially liquid and vapor tight seal therewith, each of said plurality of overlapped vapor-impermeable shield sections being formed with a plurality of slots adjacent to each of the overlapping edges, gasket means carried between the overlapping portions of said plurality of overlapped vapor-impermeable shield sections, and fastener means passing through said plurality of slots formed in each of said plurality of overlapped vapor-impermeable shield sections, and said gasket means carried therebetween, for structurally interlocking said plurality of overlapped vapor-impermeable shield sections while allowing transverse movement therebetween in response to variation in rim space during relative movement between the floating roof and the inner wall of the liquid storage tank to form a substantially liquid and vapor tight seal between said overlapping edges.

12. The sealing system of claim 11 wherein said plurality of overlapped vapor-impermeable shield sections are formed with said plurality of slots which are adjacent to the underlapped edge extending a greater length than the plurality of slots adjacent to the overlapped edge.

13. The sealing system of claim 12 wherein said vapor-impermeable shield sections are trapezoidal shaped.

14. The sealing system of claim 11 wherein said plurality of vapor-impermeable shield sections are formed with said plurality of slots transversing a radial line passing substantially through the center of said roof.

15. The sealing system of claim 14 wherein said vapor-impermeable shield sections are trapezoidal shaped.

16. The sealing system of claim 14 wherein said plurality of slots are positioned perpendicular to said radially extending center line.

17. The sealing system of claim 14 wherein said vapor-impermeable shield sections are trapezoidal shaped.

18. The sealing system of claim 11 wherein said vapor-impermeable shield sections are trapezoidal shaped.

19. The sealing system of claim 11 wherein said vapor-impermeable shield means is formed with a vertically upwardly extending portion for further elevating said shield sections above said floating roof.

20. The sealing system of claim 11 wherein said flexible sealing member comprises a wiper blade seal.

* * * * *

UNITED STATES PATENT AND TRADEMARK OFFICE

CERTIFICATE OF CORRECTION

PATENT NO. : 4,191,303

DATED : March 4, 1980

INVENTOR(S) : Mark D. Kinghorn, Sr. and Mark D. Kinghorn, Jr.

It is certified that error appears in the above—identified patent and that said Letters Patent is hereby corrected as shown below:

Claim 17, line 1, the numeral "14" should be "16".

Signed and Sealed this

*Twenty-fourth* Day of *June 1980*

[SEAL]

*Attest:*

SIDNEY A. DIAMOND

*Attesting Officer*

*Commissioner of Patents and Trademarks*